US010705459B2

(12) United States Patent
Harada

(10) Patent No.: US 10,705,459 B2
(45) Date of Patent: Jul. 7, 2020

(54) HEATING SYSTEM

(71) Applicant: BROTHER KOGYO KABUSHIKI KAISHA, Nagoya-shi, Aichi-ken (JP)

(72) Inventor: Yuya Harada, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/364,419

(22) Filed: Mar. 26, 2019

(65) Prior Publication Data

US 2019/0302662 A1 Oct. 3, 2019

(30) Foreign Application Priority Data

Mar. 30, 2018 (JP) ..... 2018-068551

(51) Int. Cl.
*G03G 15/20* (2006.01)
*H05B 1/02* (2006.01)

(52) U.S. Cl.
CPC ..... *G03G 15/2039* (2013.01); *H05B 1/0241* (2013.01)

(58) Field of Classification Search
CPC ..... G03G 15/2039; G03G 15/80; G03G 15/2053; G03G 15/5004
See application file for complete search history.

(56) References Cited

U.S. PATENT DOCUMENTS

2011/0095011 A1* 4/2011 Kawazu ..... G03G 15/2039 219/216
2016/0139548 A1* 5/2016 Kosaka ..... G03G 15/2039 399/67
2017/0248894 A1* 8/2017 Yada ..... G03G 15/2039

FOREIGN PATENT DOCUMENTS

| | | | |
|---|---|---|---|
| JP | 2003-86332 A | | 3/2003 |
| JP | 2013-61900 A | | 4/2013 |
| JP | 2013-66334 A | | 4/2013 |
| JP | 2013-70526 A | | 4/2013 |
| JP | 2013061900 A | * | 4/2013 |
| JP | 2013-97602 A | | 5/2013 |
| JP | 2014-183611 A | | 9/2014 |
| JP | 61-23325 B2 | | 5/2017 |

* cited by examiner

*Primary Examiner* — Walter L Lindsay, Jr.
*Assistant Examiner* — Jessica L Eley
(74) *Attorney, Agent, or Firm* — Merchant & Gould P.C.

(57) ABSTRACT

A heating system includes a heater, a switch providing alternating current to the heater, and a current sensor electrically connected between the switch and the heater. The heating system also includes a controller that controls operation of the switch. The controller activates the switch during a portion of a half cycle of the alternating current having increasing amplitude under a threshold. The controller determines, based on a signal received from the current sensor during the activation of the switch, a time period from the start of the half cycle to a threshold timing at which the alternating current reaches the threshold. The controller reactivates the switch at a timing on or after a timing obtained by subtraction of the determined time period from an end of the half cycle. The heating system is useable within an image forming apparatus.

12 Claims, 6 Drawing Sheets

HEATING SYSTEM

CROSS-REFERENCE TO RELATED APPLICATION

This application claims priority from Japanese Patent Application No. 2018-068551 filed on Mar. 30, 2018, the content of which is incorporated herein by reference in its entirety.

TECHNICAL FIELD

Aspects disclosed herein relate to a heating system.

BACKGROUND

In some image forming apparatuses including at least one heater, a known technique has been used for shortening First Print Out Time ("FPOT"), which is a time taken by an image forming apparatus from receiving a print request to outputting the first page, while limiting power supply to the one or more heaters. For example, in one image forming apparatus, voltage application is executed two times during a half cycle of alternating current. More specifically, the first voltage application starts at a timing at which a phase angle of the alternating current becomes 0 (zero) degree and ends at a timing at which the phase angle becomes an angle smaller than $\pi/2$ radians. The second voltage application starts at a timing at which the phase angle becomes an angle greater than $\pi/2$ radians but smaller than $\pi$ radians and ends at a timing at which the phase angle becomes $\pi$ radians. The timing at which the first voltage application ends and the timing at which the second voltage application starts are determined based on, for example, data obtained by, for example, experiment in advance.

SUMMARY

One or more aspects of the disclosure provide for a heating system that may shorten time required for one or more heaters to reach respective predetermined temperatures while limiting power supply to the one or more heaters.

In a first aspect, a heating system includes a first heater, a current sensor connected in series to the first heater, and a first switch connected in series to the first heater. The first switch is configured to: in response to receiving a first ON signal, change to a conducting state; and in response to receiving a first OFF signal, change to a non-conducting state. The heating system further includes a controller configured to: output the first ON signal to the first switch at a first timing within a portion of a half cycle of alternating current having increasing amplitude; output the first OFF signal to the first switch at a second timing earlier than a first threshold timing, the first threshold timing being a timing at which a signal received from the current sensor reaches a threshold within the portion of the half cycle having increasing amplitude; determine, based on a signal received from the current sensor at a predetermined timing between the first timing and the second timing, a time period from the start of the half cycle of the alternating current to the first threshold timing; obtain a third timing by subtraction of the determined time period from an end of the half cycle of the alternating current; and output the first ON signal to the first switch at a timing on or after the obtained the third timing.

In a second aspect, a heating system includes a heater, a switch electrically connected between an alternating current power supply and the heater. The switch is configured to: in response to receiving an ON signal, change to a conducting state to provide alternating current from the alternating current power supply to the heater; and in response to receiving an OFF signal, change to a non-conducting state to interrupt the alternating current. The heating system also includes a current sensor electrically connected between the switch and the heater. The heating system further includes a controller configured to: output the ON signal to the switch at a first timing within a portion of a half cycle of alternating current having increasing amplitude; output the OFF signal to the switch at a second timing earlier than a threshold timing at which the alternating current reaches a threshold within the portion of the half cycle having increasing amplitude; determine, based on a signal received from the current sensor at a predetermined timing between the first timing and the second timing, a time period from the start of the half cycle of the alternating current to the threshold timing; obtain a third timing by subtraction of the determined time period from an end of the half cycle of the alternating current; and output the ON signal to the switch at a timing on or after the obtained the third timing.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
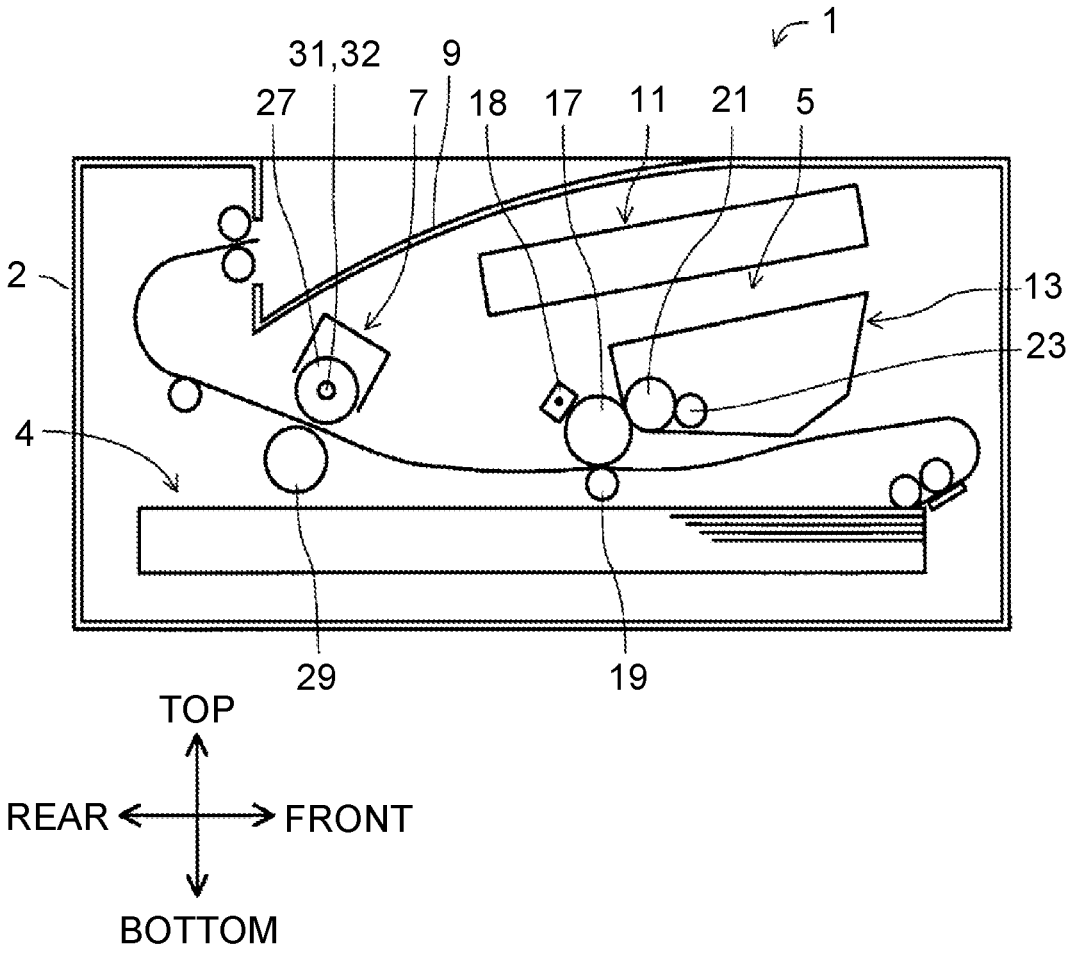
FIG. 1 is a sectional view illustrating a laser printer in an illustrative embodiment according to one or more aspects of the disclosure.

A first illustrative embodiment will be described with reference to the accompanying drawings. FIG. 1 is a sectional view illustrating a monochrome laser printer 1 in the first illustrative embodiment according to one or more aspects of the disclosure. In the printer 1, an image forming unit 5 forms a toner image onto a sheet fed from a tray 4 disposed in a lower portion of a casing 2. A fixing device 7 then thermally fixes the toner image on the sheet. Thereafter, the printer 1 discharges the sheet onto a discharge tray 9 defined at the top of the casing 2. Hereinafter, an explanation will be provided with reference to directions, top, bottom, front, and rear, as defined in FIG. 1. The right and left of the printer 1 are defined as viewed from the front of the printer 1. These directions will be used throughout the following explanation.

The image forming unit 5 includes a scanner 11, a developer cartridge 13, a photosensitive drum 17, a charger 18, and a transfer roller 19. The scanner 11 is disposed in an upper portion of the casing 2. The scanner 11 emits a laser beam from a laser emitter (not illustrated) onto a circumferential surface of the photosensitive drum 17 via a polygon mirror, a reflector, and a lens (not illustrated).

The developer cartridge 13 is detachably attachable to the casing 2 of the printer 1. The developer cartridge 13 stores toner therein. The developer cartridge 13 includes a developing roller 21 and a supply roller 23, which are disposed facing each other. The developing roller 21 also faces the photosensitive drum 17. The supply roller 23 supplies toner to the developing roller 21 from the developer cartridge 13.

The charger 18 is disposed obliquely above and further to the rear than at least a portion of the photosensitive drum 17 while being spaced from the photosensitive drum 17. The transfer roller 19 is disposed below the photosensitive drum 17 and faces the photosensitive drum 17. For example, the charger 18 positively and uniformly charges the circumferential surface of the photosensitive drum 17 while the photosensitive drum 17 rotates. Thereafter, the scanner 11 forms an electrostatic latent image onto the charged circumferential surface of the photosensitive drum 17 using a laser beam. Subsequently, the developing roller 21 rotates to supply toner onto the circumferential surface of the photosensitive drum 17 having the electrostatic latent image. The photosensitive drum 17 thus has a toner image on its circumferential surface. The transfer roller 19 then transfers the toner image onto a sheet by a bias applied to the transfer roller 19 while the sheet passes between the photosensitive drum 17 and the transfer roller 19.

The fixing device 7 is disposed downstream from the image forming unit 5 in a sheet conveying direction (in a rear portion of the printer 1). The fixing device 7 includes a fixing roller 27, a pressure roller 29, a main heater 31, and an auxiliary heater 32. The pressure roller 29 presses the fixing roller 27. The main heater 31 and the auxiliary heater 32 are configured to heat the fixing roller 27. The fixing roller 27 rotates by driving of an electronic motor (not illustrated) controlled by a controller 33 (refer to FIG. 2). The fixing roller 27 heats toner on a sheet while applying a conveying force to the sheet. The pressure roller 29 rotates by rotation of the fixing roller 27 while applying pressure toward the fixing roller 27. The main heater 31 and the auxiliary heater 32 may be halogen heaters. The main heater 31 and the auxiliary heater 32 are each configured to be energized or de-energized by control of the controller 33 of a heating system 30 (refer to FIG. 2). The main heater 31 includes end portions and a middle portion between the end portions in its axial direction. The main heater 31 is configured such that the middle portion generates more heat than the end portions. The main heater 31 is disposed within an internal space of the fixing roller 27 while the middle portion of the main heater 31 corresponds to a middle portion of the fixing roller 27 in an axial direction of the fixing roller 27. The auxiliary heater 32 includes end portions and a middle portion between the end portions in its axial direction. The auxiliary heater 32 is configured such that the end portions generate more heat than the middle portion. The auxiliary heater 32 is also disposed within the internal space of the fixing roller 27 while the end portions of the auxiliary heater 32 correspond to respective end portions of the fixing roller 27 in the axial direction of the fixing roller 27.

Figure 2:
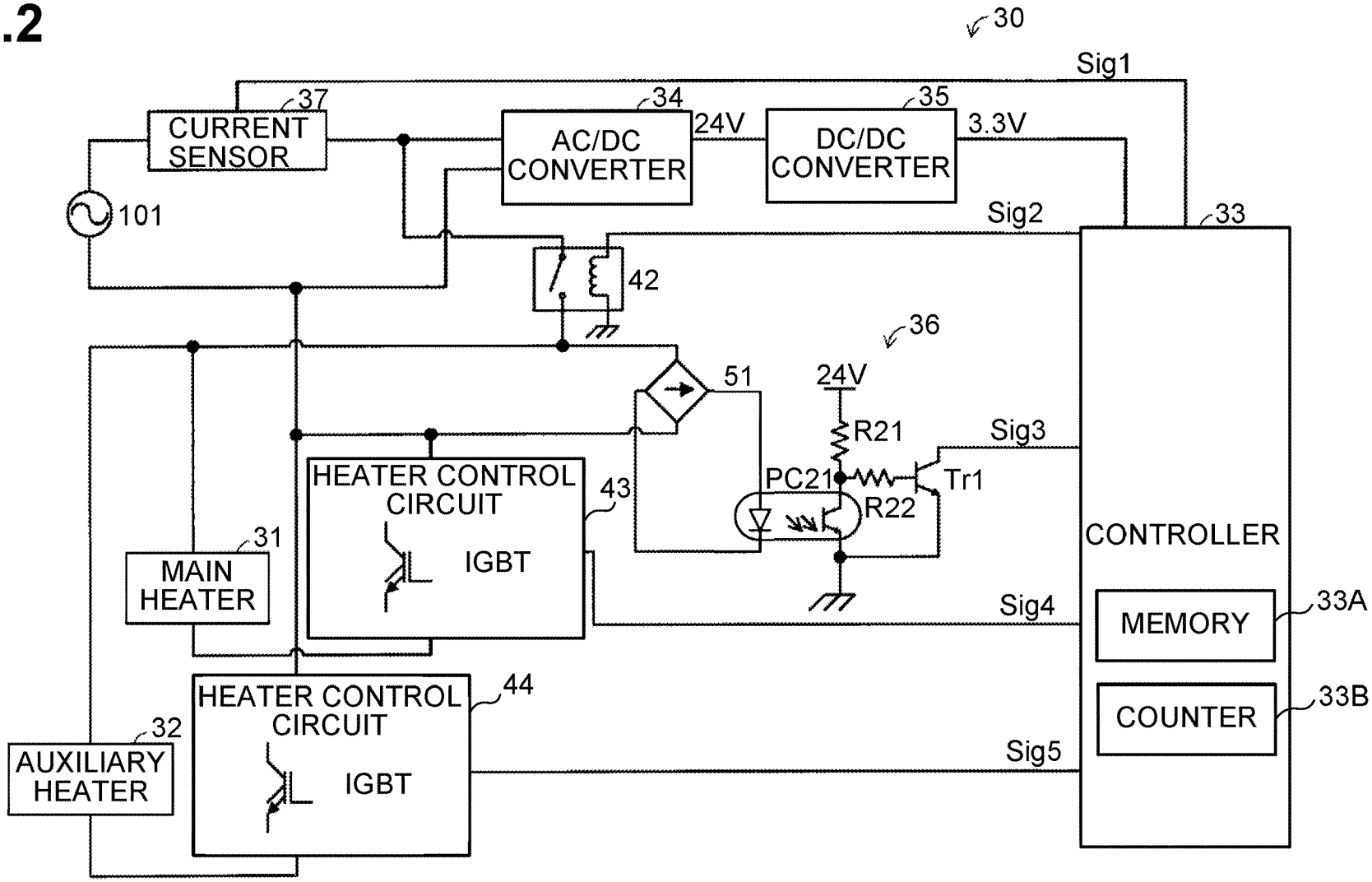
FIG. 2 is a circuit diagram of a heating system in the illustrative embodiment according to one or more aspects of the disclosure.

As illustrated in FIG. 2, the heating system 30 includes the main heater 31, the auxiliary heater 32, the controller 33, an AC/DC converter 34, a DC/DC converter 35, a zero-crossing detector circuit 36, a current sensor 37, a relay 42, heater control circuits 43 and 44, and an AC supply 101. In one example, the controller 33 may mainly include one or more programs executed on a CPU. In another example, the controller 33 may include dedicated hardware such as an ASIC. In still another example, the controller 33 may be configured to operate by combined execution of processing executed by software and processing executed by hardware. The controller 33 includes a memory 33A and a counter 33B. The memory 33A includes, for example, a RAM, a ROM, and a flash memory. The memory 33A is configured to store various information on control and processing, and programs for heater control processing. The counter 33B is configured to measure time. The heating system 30 is installed within the printer 1.

The main heater 31 and the auxiliary heater 32 are each configured to heat by power supplied by the AC supply 101. The auxiliary heater 32 is connected in parallel to the main heater 31. In the first illustrative embodiment, the main heater 31 consumes more power than the auxiliary heater 32. The AC/DC converter 34 converts, for example, 100 V alternating voltage into 24 V direct voltage and outputs 24 V direct voltage to the DC/DC converter 35. The DC/DC converter 35 converts 24 V direct voltage into 3.3 V direct voltage and supplies 3.3 V direct voltage to, for example, the controller 33. The current sensor 37 is connected in series to the main heater 31 and the auxiliary heater 32. The current sensor 37 outputs, to the controller 33, a signal Sig1 responsive to intensity of current that flows from the AC supply 101 to one or the other or both of the main heater 31 and the auxiliary heater 32. The main heater 31 and the auxiliary heater 32 both consume current considerably greater than the controller 33 or others. Thus, the controller 33 ignores current consumed by the controller 33 or others and regards the intensity of current measured by the current sensor 37 as the intensity of current that passes through one or the other or both of the main heater 31 and the auxiliary heater 32. The current sensor 37 includes a Hall element and an amplifier circuit. The current sensor 37 converts a magnetic field occurring in proportion to current into voltage by the Hall effect of the Hall element. The current sensor 37 outputs, to the controller 33, the converted voltage amplified by the amplifier circuit. In another example, instead of the Hall element, the current sensor 37 may include a fluxgate magnetic sensor. In the following explanation, current that passes through one or the other or both of the main heater 31 and the auxiliary heater 32, i.e., current that passes through the current sensor 37, may be referred to as heater current. The relay 42 switches between electrical connection and disconnection of the AC supply 101 to and from each of the main heater 31 and the auxiliary heater 32, based on a signal Sig2 outputted by the controller 33.

In response to detecting zero-crossing of alternating current supplied by the AC supply 101, the zero-crossing detector circuit 36 outputs a signal Sig3 to the controller 33. The signal Sig3 may be a pulse signal. More specifically, for example, the zero-crossing detector circuit 36 includes a diode bridge 51, a photocoupler PC21, resistors R21 and R22, and a transistor Tr1. The transistor Tr1 may be an NPN bipolar transistor. The diode bridge 51 provides full-wave rectification for the AC supply 101. The full-wave rectified power of the AC supply 101 is then applied to an LED of the photocoupler PC21. The photocoupler PC21 includes a phototransistor having a collector terminal and an emitter terminal. The collector terminal is connected to a 24V DC supply via the resistor R21. The emitter terminal is grounded. The transistor Tr1 has a base terminal, a collector terminal, and an emitter terminal. The base terminal is connected to a connection point of the resistor R21 and the photocoupler PC21. The collector terminal is connected to the controller 33. The emitter terminal is grounded. A line connecting between the collector terminal of the transistor Tr1 and the controller 33 is pulled up by power supply voltage inside the controller 33. The LED of the photocoupler PC21 is configured to emit light, whose amount corresponds to voltage applied thereto. As voltage applied to the LED of the photocoupler PC21 becomes lower, an ON-resistance of the phototransistor of the photocoupler PC21 increases and a base voltage of the transistor Tr1 thus becomes higher. In response to the base voltage of the transistor Tr1 exceeding a threshold, the transistor Tr1 turns on and the signal Sig3 is changed to a low level. Therefore, the signal Sig3 outputted by the zero-crossing detector circuit 36 indicates a low level before and after each zero-crossing of alternating current supplied by the AC supply 101 occurs. The controller 33 determines, based on a signal Sig3 inputted thereto, a zero-crossing timing at which alternating current that flows between the AC supply 101 and the zero-crossing detector circuit 36 crosses zero.

The heater control circuits 43 and 44 each include an insulated gate bipolar transistor ("IGBT"). The IGBT of the heater control circuit 43 is connected in series to the main heater 31 and in parallel to the auxiliary heater 32. The IGBT of the heater control circuit 44 is connected in serial to the auxiliary heater 32 and is parallel to the main heater 31. The IGBT of the heater control circuit 43 has a collector terminal and an emitter terminal, one of which is connected to one of poles of the AC supply 101 and the other of which is connected to the other of the poles of the AC supply 101 via the main heater 31 and the relay 42. The heater control circuit 43 receives a signal Sig4 outputted by the controller 33. The signal Sig4 is for controlling energization and de-energization of the main heater 31. The heater control circuit 43 changes between a conducting state and a non-conducting state in accordance with a level of the signal Sig4. More specifically, for energizing the main heater 31, the controller 33 changes the signal Sig4 to a level that causes the IGBT of the heater control circuit 43 to have the conducting state. The signal Sig4 having the level that causes the IGBT of the heater control circuit 43 to have the conducting state is an example of a second ON signal. In response to the heater control circuit 43 receiving such a signal Sig4 from the controller 33, the IGBT of the heater control circuit 43 changes to the conducting state, thereby enabling the main heater 31 to be energized. For de-energizing the main heater 31, the controller 33 changes the signal Sig4 to another level that causes the IGBT of the heater control circuit 43 to have the non-conducting state. The signal Sig4 having the level that causes the IGBT of the heater control circuit 43 to have the non-conducting state is an example of a second OFF signal. In response to the heater control circuit 43 receiving such a signal Sig4 from the controller 33, the IGBT of the heater control circuit 43 changes to the non-conducting state, thereby enabling the main heater 31 to be de-energized. The auxiliary heater 32 is controlled in the same manner. That is, the IGBT of the heater control circuit 44 has a collector terminal and an emitter terminal, one of which is connected to one of poles of the AC supply 101 and the other of which is connected to the other of the poles of the AC supply 101 via the auxiliary heater 32 and the relay 42. The heater control circuit 44 receives a signal Sig5 outputted by the controller 33. The signal Sig5 is for controlling energization and de-energization of the auxiliary heater 32. The heater control circuit 44 changes between a conducting state and a non-conducting state in accordance with a level of the signal Sig5. More specifically, for energizing the auxiliary heater 32, the controller 33 changes the signal Sig5 to a level that causes the IGBT of the heater control circuit 44 to have the conducting state. In response to the heater control circuit 43 receiving a signal Sig5 having such a level from the controller 33, the IGBT of the heater control circuit 44 changes to the conducting state, thereby enabling the auxiliary heater 32 to be energized. For de-energizing the auxiliary heater 32, the controller 33 changes the signal Sig5 to another level that causes the IGBT of the heater control circuit 44 to have the non-conducting state. The signal Sig5 having the level that causes the IGBT of the heater control circuit 44 to have the non-conducting state is an example of a first OFF signal. In response to the heater control circuit 43 receiving such a signal Sig5 from the controller 33, the IGBT of the heater control circuit 44 changes to the non-conducting state, thereby enabling the auxiliary heater 32 to be de-energized. In the following explanation, the phrase indicating that "the controller 33 causes the IGBT of the heater control circuit 43 to have the conducting state by inputting the signal Sig4 having a predetermined level to the heater control circuit 43" is referred to, for example, as "the controller 33 turns the main heater 31 on" or "the main heater 31 is turned on". The phrase indicating that "the controller 33 causes the IGBT of the heater control circuit 44 to have the conducting state by inputting the signal Sig5 having a predetermined level to the heater control circuit 44" is referred to, for example, as "the controller 33 turns the auxiliary heater 32 on" or "the auxiliary heater 32 is turned on". Further, the phrase indicating that "the controller 33 causes the IGBT of the heater control circuit 43 to have the non-conducting state by inputting, to the heater control circuit 43, the signal Sig4 having another level different from the predetermined level" is referred to, for example, as "the controller 33 turns the main heater 31 off" or "the main heater 31 is turned off". The phrase indicating that "the controller 33 causes the IGBT of the heater control circuit 44 to have the non-conducting state by inputting, to the heater control circuit 44, the signal Sig5 having another level different from the predetermined level" is referred to, for example, as "the controller 33 turns the auxiliary heater 32 off" or "the auxiliary heater 32 is turned off".

Figure 3:
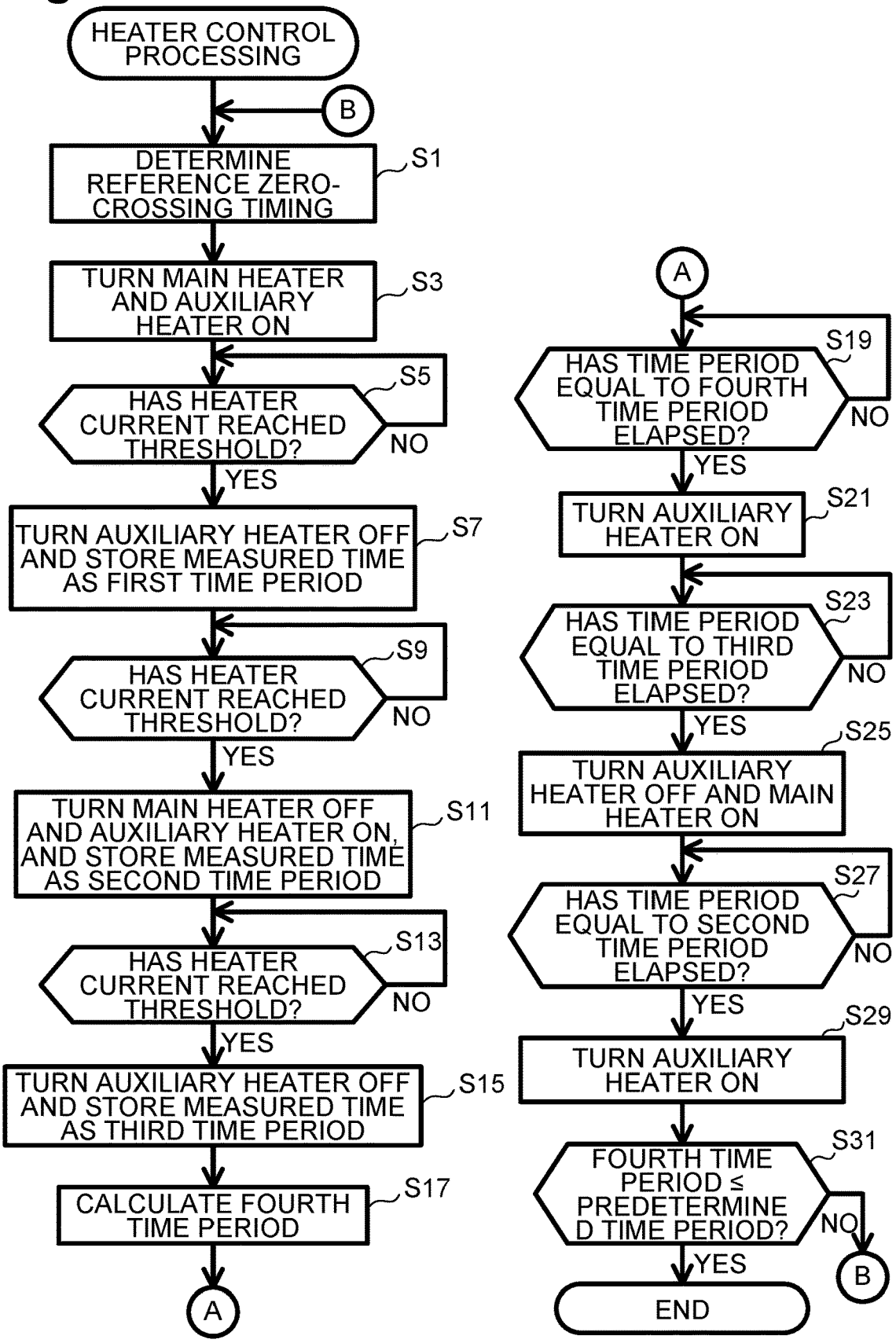
FIG. 3 is a flowchart of heater control processing in the illustrative embodiment according to one or more aspects of the disclosure.

In response to, for example, turning-on of the printer 1, the controller 33 starts heater control processing (refer to FIG. 3). In response to the turning-on of the printer 1, the controller 33 changes the signal Sig2 to the level that causes the contact of the relay 42 to be closed.

The controller 33 determines a reference zero-crossing timing based on an inputted signal Sig3 (e.g., step S1). Subsequent to step S1, at the reference zero-crossing timing, the controller 33 turns both of the main heater 31 and the auxiliary heater 32 on and causes the counter 33B to start measuring time (e.g., step S3). Subsequent to step S3, the controller 33 determines whether the heater current detected based on a currently input signal Sig1 has reached a threshold TH1 prestored in the memory 33A (e.g., step S5). The threshold TH1 is defined by the intensity of current that does not depend on the direction of current flow. That is, in step S5, the controller 33 determines whether an absolute value of the heater current detected based on the currently input signal Sig1 has reached the threshold TH1. The controller 33 executes the same determination in similar steps using the threshold TH1 subsequently executed. The threshold TH1 may indicate a lower limit of a current range AM having an upper limit that may be equal to rated current TH2. If the controller 33 determines that the heater current has not reached the threshold TH1 (e.g., NO in step S5), the routine returns to step S5. The controller 33 repeats the processing of step S5 until the controller 33 makes a positive determination (e.g., "YES") in step S5. If the controller 33 determines that the heater current has reached the threshold TH1 (e.g., YES in step S5), the controller 33 turns the auxiliary heater 32 off. An increase of the heater current from a timing at which the controller 33 makes a negative determination (e.g., "NO") in step S5 to a timing at which the controller 33 then makes a positive determination (e.g., "YES") in step S5 is smaller than difference between the threshold TH1 and the rated current TH2 of the current range AM. In each of steps S9 and S13, the controller 33 executes the same determination as the controller 33 executes in step S5. Further, in step S7, the controller 33 causes the counter 33B to stop measuring time, and stores the measured time in the memory 33A as a time period TD1. In addition, the controller 33 causes the counter 33B to reset and newly start measuring time (e.g., step S7). Subsequent to step S7, the controller 33 determines whether the heater current detected based on the signal Sig1 has reached the threshold TH1 (e.g., step S9). During this period, the auxiliary heater 32 stays off. Therefore, the heater current flowing during this period includes current passing through the main heater 31 only. If the controller 33 determines that the heater current has not reached the threshold TH1 (e.g., NO in step S9), the routine returns to step S9. The controller 33 repeats the processing of step S9 until the controller 33 makes a positive determination (e.g., "YES") in step S9. If the controller 33 determines that the heater current has reached the threshold TH1 (e.g., YES in step S9), the controller 33 turns the main heater 31 off and the auxiliary heater 32 on. Subsequent to step S9, the controller 33 causes the counter 33B to stop measuring time, and stores the measured time in the memory 33A as a time period TD2. In addition, the controller 33 causes the counter 33B to reset and newly start measuring time (e.g., step S11).

Subsequent to step S11, the controller 33 determines whether the heater current detected based on the currently input signal Sig1 has reached the threshold TH1 (e.g., step S13). During this period, the main heater 31 stays off. Therefore, the heater current flowing during this period includes current passing through the auxiliary heater 32 only. If the controller 33 determines that the heater current has not reached the threshold TH1 (e.g., NO in step S13), the routine returns to step S13. The controller 33 repeats the processing of step S13 until the controller 33 makes a positive determination (e.g., "YES") in step S13. If the controller 33 determines that the heater current has reached the threshold TH1 (e.g., YES in step S13), the controller 33 turns the auxiliary heater 32 off. Subsequent to step S13, the controller 33 causes the counter 33B to stop measuring time, and stores the measured time in the memory 33A as a time period TD3. In addition, the controller 33 causes the counter 33B to reset and newly start measuring time (e.g., step S15). Subsequent to step S15, the controller 33 calculates a time period TD4 using a time period T of alternating current supplied by the AC supply 101 and stores the obtained time period TD4 in the memory 33A (e.g., step S17).

$$TD4=T/2-(TD1+TD2+TD3)*2$$

Subsequent to step S17, the controller 33 determines, based on the time being measured by the counter 33B, whether a time period equal to the time period TD4 stored in the memory 33A has elapsed from the start of the processing of step S15 (e.g., step S19). If the controller 33 determines that a time period equal to the time period TD4 has not elapsed yet (e.g., NO in step S19), the routine returns to step S19. The controller 33 repeats the processing of step S19 until the controller 33 makes a positive determination (e.g., "YES") in step S19. If the controller 33 determines that a time period equal to the time period TD4 has elapsed (e.g., YES in step S19), the controller 33 turns the auxiliary heater 32 on, and causes the counter 33B to stop measuring time. Further, the controller 33 causes the counter 33B to reset and newly start measuring time (e.g., step S21). Subsequent to step S21, the controller 33 determines, based on the time being measured by the counter 33B, whether a time period equal to the time period TD3 stored in the memory 33A has elapsed from the start of the processing of step S21 (e.g., step S23). If the controller 33 determines that a time period equal to the time period TD3 has not elapsed yet (e.g., NO in step S23), the routine returns to step S23. The controller 33 repeats the processing of step S23 until the controller 33 makes a positive determination (e.g., "YES") in step S23. If the controller 33 determines that a time period equal to the time period TD3 has elapsed (e.g., YES in step S23), the controller 33 turns the auxiliary heater 32 off and the main heater 31 on. Further, the controller 33 causes the counter 33B to stop measuring time and to reset and newly start measuring time (e.g., step S25).

Subsequent to step S25, the controller 33 determines, based on the time being measured by the counter 33B, whether a time period equal to the time period TD2 stored in the memory 33A has elapsed from the start of the processing of step S25 (e.g., step S27). If the controller 33 determines that a time period equal to the time period TD2 has not elapsed yet (e.g., NO in step S27), the routine returns to step S27. The controller 33 repeats the processing of step S27 until the controller 33 makes a positive determination (e.g., "YES") in step S27. If the controller 33 determines that a time period equal to the time period TD2 has elapsed (e.g., YES in step S27), the controller 33 turns the auxiliary heater 32 on (e.g., step S29). Subsequent to step S29, the controller 33 determines whether the time period TD4 is shorter than or equal to a predetermined time period (e.g., step S31). If the controller 33 determines that the time period TD4 is not shorter than or equal to the predetermined time period (e.g., NO in step S31), the routine returns to step S1. If the controller 33 determines that the time period TD4 is shorter than or equal to the predetermined time period (e.g., YES in step S31), the controller 33 ends the heater control processing. If the routine returns to step S1, the controller 33 starts again the processing of step S3 and its subsequent steps at another determined reference zero-crossing timing. That is, the controller 33 executes processing of steps S1 to S31 during each half cycle of alternating current supplied by the AC supply 101.

Figure 4:
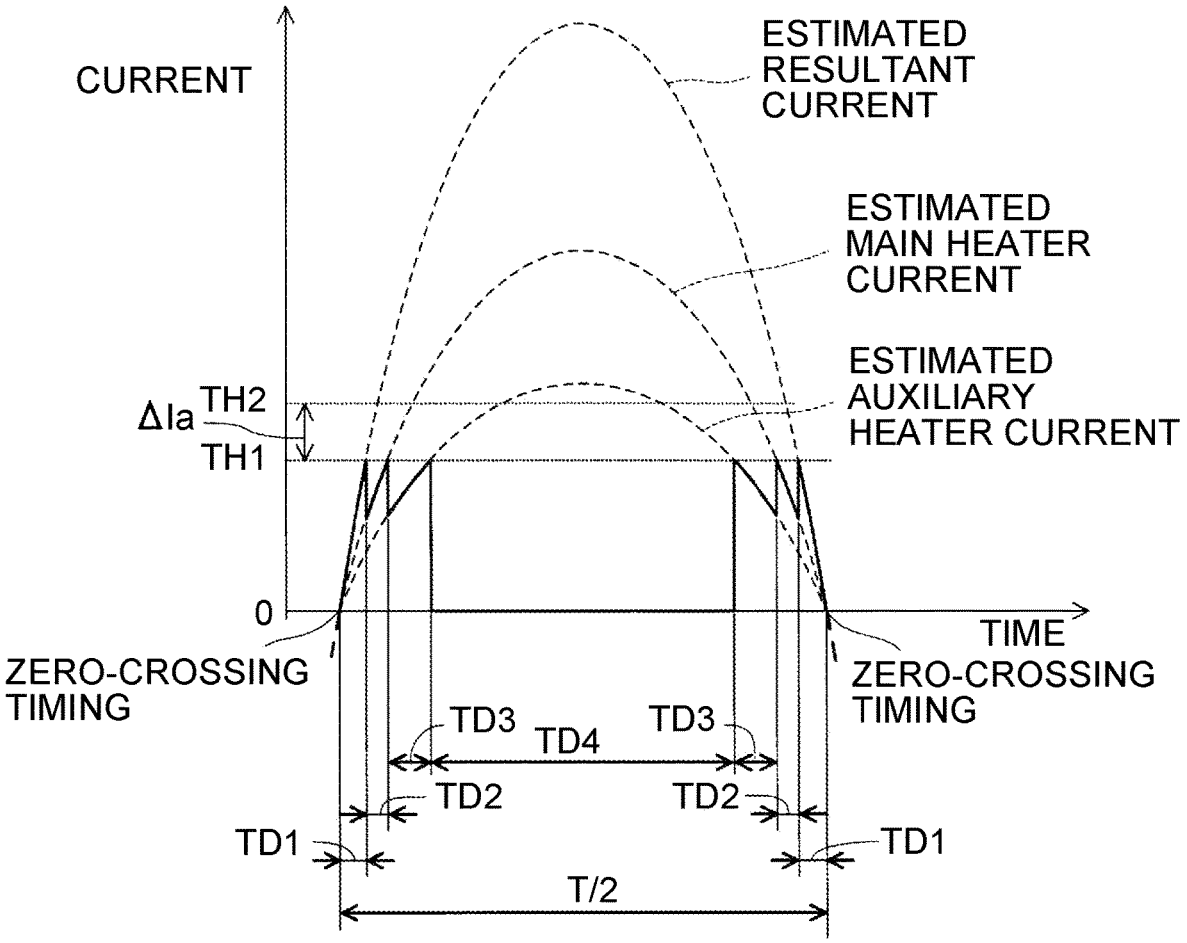
FIG. 4 is a chart showing a waveform transition during a half cycle of heater current in the heater control processing in the illustrative embodiment according to one or more aspects of the disclosure.

Referring to FIG. 4, the heater control processing will be described. In a waveform chart, a horizontal axis indicates time and a vertical axis indicates current. A waveform of the heater current is indicated by a solid line. A waveform of current that may pass through the main heater 31 that is assumed to have undergone a wave number control is indicated by a dashed line. This current is referred to as an "estimated main heater current". A waveform of current that may pass through the auxiliary heater 32 that is assumed to have undergone the wave number control is indicated by a dashed line. This current is referred to as an "estimated auxiliary heater current". A waveform of resultant current of the current that may pass through the main heater 31 that is assumed to have undergone the wave number control and the current that may pass through the auxiliary heater 32 that is assumed to have undergone the wave number control is indicated by a dashed line. This resultant current is referred to as an "estimated resultant current". In FIGS. 5, 6, 9, and 10, the estimated main heater current, the estimated auxiliary heater current, and the estimated resultant current are indicated in the same manner. In the wave number control, current is continuously applied to either one or both of the main heater 31 and the auxiliary heater 32 in a half cycle of alternating current supplied by the AC supply 101. For example, if the wave number control is executed on the main heater 31, current is continuously applied to the main heater 31 in a half cycle of alternating current supplied by the AC supply 101 from a reference zero-crossing timing which corresponds to the start of the half cycle to the next zero-crossing timing which corresponds to the end of the half cycle. The same wave number control may be executed on the auxiliary heater 32.

In response to the determination of a reference zero-crossing timing in step S1, the main heater 31 and the auxiliary heater 32 are both turned on in step S3. As a phase angle of current in the AC supply 101 increases, the resultant current becomes higher. In response to the resultant current reaching the threshold TH1, the auxiliary heater 32 is turned off in step S7. The time period from the determined zero-crossing timing to the timing at which the auxiliary heater 32 is turned off corresponds to the time period TD1. After the auxiliary heater 32 is turned off in step S7, the heater current flowing currently includes the current that passes through the main heater 31 only and thus the heater current becomes lower. As the phase angle of current in the AC supply 31 increases while only the main heater 31 stays on, the heater current becomes higher. In response to the heater current reaching the threshold TH1, the main heater 31 is turned off and the auxiliary heater 32 is turned on in step S11. The time period from the timing at which the auxiliary heater 32 is turned off to the timing at which the main heater 31 is turned off and the auxiliary heater 32 is turned on corresponds to the time period TD2. The main heater 31 consumes less power than the auxiliary heater 32. Thus, in response to turning the main heater 31 off and the auxiliary heater 32 on in step S11, the heater current becomes lower. As the phase angle of current in the AC supply 32 increases while only the auxiliary heater 32 stays on, the heater current becomes higher. In response to the heater current reaching the threshold TH1, the auxiliary heater 32 is turned off in step S15. That is, the main heater 31 and the auxiliary heater 32 are both turned off and the heater current becomes approximate to zero. The time period from the timing at which the main heater 31 is turned off and the auxiliary heater 32 is turned on to the timing at which the auxiliary heater 32 is turned off corresponds to the time period TD3.

In response to a time period equal to the time period TD4 elapsing since the main heater 31 and the auxiliary heater 32 are both turned off, in step S21, the auxiliary heater 32 is turned on. In response to a time period equal to the time period TD3 elapsing since the auxiliary heater 32 is turned on, in step S23, the auxiliary heater 32 is turned off and the main heater 31 is turned on. In response to a time period equal to the time period TD2 elapsing since the auxiliary heater 32 is turned off and the main heater 31 is turned on, the auxiliary heater 32 is turned on. As described above, in a half cycle, during the period from the reference zero-crossing timing to the timing at which the first one-quarter of the half cycle ends, the main heater 31 stays on for a particular duration. During the remaining period from the timing at which the first one-quarter of the half cycle ends to the next zero-crossing timing in the half cycle, the main heater 31 also stays on for the same duration as the main heater 31 stays on during the first one-quarter of the half cycle. Further, in the half cycle, during the period from the reference zero-crossing timing to the timing at which the first one-quarter of the half cycle ends, the auxiliary heater 32 stays on for a particular duration. During the remaining period from the timing at which the first one-quarter of the half cycle ends to the next zero-crossing timing in the half cycle, the auxiliary heater 32 also stays on for the same duration as the auxiliary heater 32 stays on during the first one-quarter of the half cycle.

Figure 5:
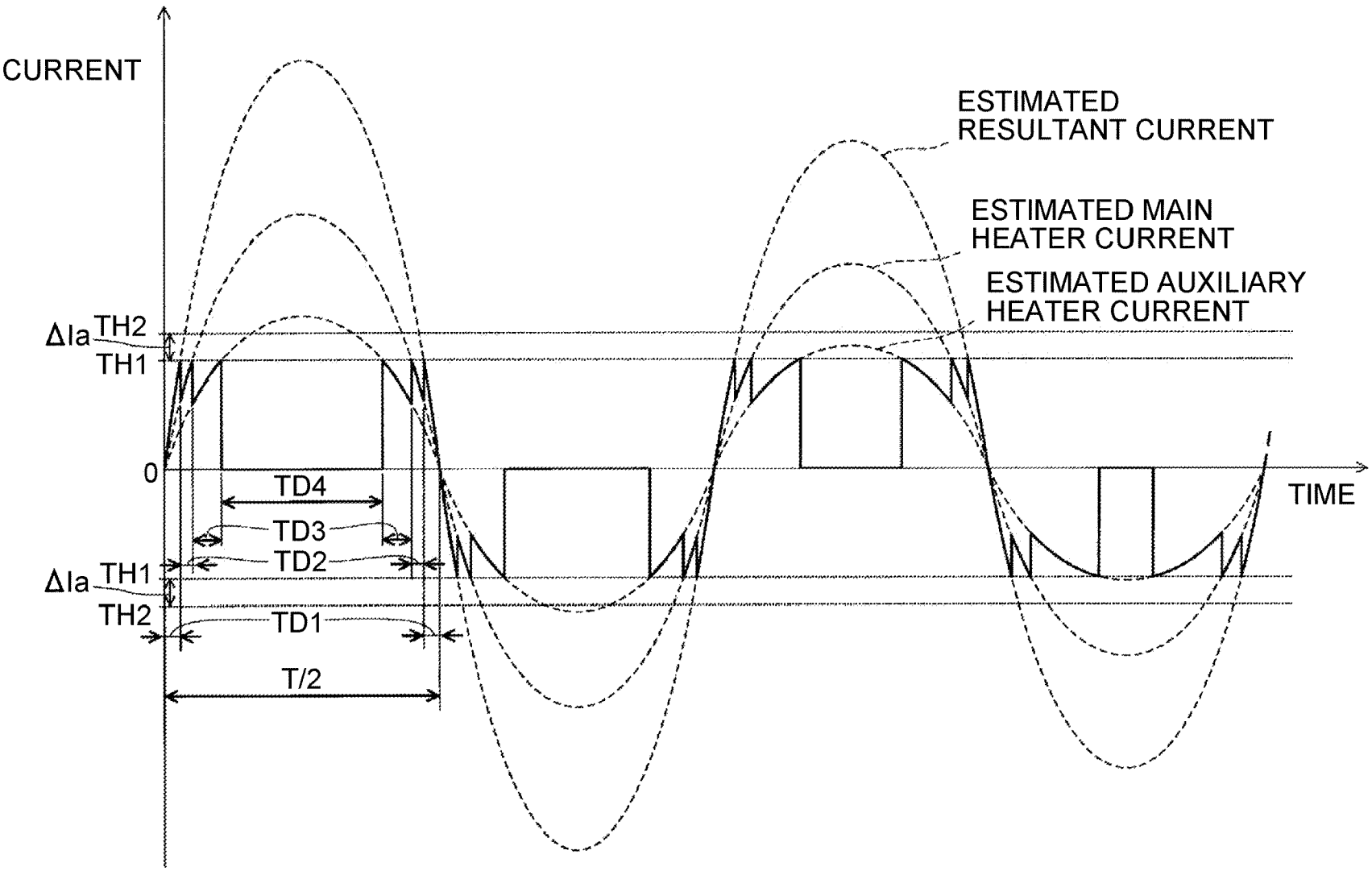
FIG. 5 is a chart showing a waveform transition during each full cycle of the heater current in the heater control processing in the illustrative embodiment according to one or more aspects of the disclosure.

As the temperature of a halogen heater rises due to a long duration of energization, the resistance of the halogen heater increases. Thus, as illustrated in FIG. 5, the heater current becomes lower gradually over time. Therefore, the duration of each of the time period TD1, the time period TD2, and the time period TD3 in each half cycle becomes longer gradually over time, and the duration of the time period TD4 becomes shorter gradually over time. If the time period TD4 is shorter than or equal to the predetermined time period in a predetermined half cycle of the AC supply 101, a peak of current that may pass through the auxiliary heater 32 that is assumed to have undergone the wave number control might not exceed the rated current TH2. Therefore, in each half cycle subsequent to the predetermined half cycle, the controller 33 may execute the wave number control on the sub heater 32. In other words, the auxiliary heater 32 stays on continuously in each half cycle subsequent to the predetermined half cycle. In step S31 (refer to FIG. 3), if the controller 33 determines that the time period TD4 is shorter than or equal to the predetermined time period (e.g., YES in step S31), the controller 33 ends the heater control processing and executes the wave number control on the auxiliary heater 32.

In this example, the printer 1 is an example of an image forming apparatus. The auxiliary heater 32 is an example of a first heater. The main heater 31 is an example of a second heater. The IGBT of the heater control circuit 44 is an example of a first switch. The IGBT of the heater control circuit 43 is an example of a second switch.

The signal Sig5 having the level that causes the IGBT of the heater control circuit 44 to have the conducting state is an example of a first ON signal. The signal Sig5 having the level that causes the IGBT of the heater control circuit 44 to have the non-conducting state is an example of a first OFF signal. The signal Sig4 having the level that causes the IGBT of the heater control circuit 43 to have the conducting state is an example of a second ON signal. The signal Sig4 having the level that causes the IGBT of the heater control circuit 43 to have the non-conducting state is an example of a second OFF signal.

The rated current TH2 is an example of a threshold. The threshold TH1 is an example of a predetermined value having a smaller value than the threshold. The timing for executing the processing of step S3 is an example of a first timing. The timing for executing the processing of step S7 is an example of a second timing. The timing for executing the processing of step S29 is an example of a third timing. The timing for executing the processing of step S3 is an example of a fourth timing. The timing for executing the processing of step S11 is an example of a fifth timing. The timing for executing the processing of step S25 is an example of a sixth timing. The timing for executing the processing of step S7 is an example of a predetermined timing. The time period TD1 is an example of a time period from the start of a half cycle of alternating current to a first threshold timing at which the alternating current reaches the threshold. The zero-crossing timing is an example of the start of a half cycle of alternating current and the end of the half cycle of alternating current.

The illustrative embodiment may thus achieve effects as follows.

In response to determining a reference zero-crossing timing in step S1, in step S3, the controller 33 changes the signal Sig5 to the level that causes the IGBT of the heater control circuit 44 to have the conducting state to cause the auxiliary heater 32 to be energized. In response to the heater current reaching or exceeding the threshold TH1, in step S7, the controller 33 changes the signal Sig5 to the level that causes the IGBT of the heater control circuit 44 to have the non-conducting state to cause the auxiliary heater 32 to be de-energized. In step S17, the controller 33 calculates the time period TD4. In step S29, the controller 33 causes the auxiliary heater 32 to be energized by changing the signal Sig5 to the level that causes the IGBT of the heater control circuit 44 to have the conducting state at a particular timing based on the time periods TD1, TD2, TD3, and TD4. The particular timing may be obtained by subtraction of the time period TD1 from the zero-crossing timing corresponding to the end of a half cycle.

Such a control may thus enable the auxiliary heater 32 to be energized two times during a half cycle of alternating current. More specifically, the auxiliary heater 32 may be energized during a time period from the reference zero-crossing timing to the timing at which the time period TD1 ends and during a time period equal to the time period TD1 from the timing obtained by subtraction of the time period TD1 from the next zero-crossing timing. While reducing or preventing the alternating current passing through the auxiliary heater 32 from exceeding the rated current TH2, this control may enable the auxiliary heater 32 to be energized more efficiently than a case where the auxiliary heater 32 becomes energized during one of the above time periods.

The controller 33 determines, based on the signal Sig1 received from the current sensor 37, the timing at which the alternating current passing through the auxiliary heater 32 may reach the threshold TH1 by decrease, i.e., the timing obtained by subtraction of the time period TD1 from the zero-crossing timing corresponding to the end of the half cycle of the alternating current, when it is assumed that the auxiliary heater 32 is continuously energized from the zero-crossing timing corresponding to the start of the half cycle of the alternating current to the zero-crossing timing corresponding to the end of the half cycle of the alternating current. At the determined timing or subsequent to the determined timing, the controller 33 causes the auxiliary heater 32 to be energized. If, therefore, the resistance property of the alternating current passing through the auxiliary heater 32 changes due to fluctuation of the resistance of the auxiliary heater 32, the timing may be determined with little influence of the property change. Further, as compared with a case where the auxiliary heater 32 becomes energized at a timing predetermined by experiment, this control may enable the auxiliary heater 32 to be energized more efficiently while reducing or preventing the alternating current passing through the auxiliary heater 32 from exceeding the rated current TH2. Consequently, this control may shorten FPOT while limiting power supply to the auxiliary heater 32.

In addition, this control may achieve accurate determination of the timing at which the heater current reaches the threshold TH1.

In response to determining a reference zero-crossing timing in step S1, in step S3, the controller 33 changes the signal Sig5 to the level that causes the IGBT of the heater control circuit 44 to have the conducting state to cause the auxiliary heater 32 to be energized. In step S29, the controller 33 causes the auxiliary heater 32 to be energized by changing the signal Sig5 to the level that causes the IGBT of the heater control circuit 44 to have the conducting state at the particular timing, which may be obtained by subtraction of the time period TD1 from the zero-crossing timing corresponding to the end of a half cycle. This control may thus enable the auxiliary heater 32 to be energized for a longer duration as compared with a case where the controller 33 causes the auxiliary heater 32 to be energized at a particular timing later than the zero-crossing timing corresponding to the start of the half cycle. In addition, this control may also enable the auxiliary heater 32 to be energized for a longer duration as compared with a case where the controller 33 causes the auxiliary heater 32 to be energized at a particular timing later than the timing obtained by subtraction of the time period TD1 from the zero-crossing timing corresponding to the end of the half cycle.

In response to determining a reference zero-crossing timing in step S1, in step S3, the controller 33 changes the signal Sig4 to the level that causes the IGBT of the heater control circuit 43 to have the conducting state to cause the main heater 31 to be energized. In response to the heater current reaching or exceeding the threshold TH1, in step S11, the controller 33 changes the signal Sig4 to the level that causes the IGBT of the heater control circuit 43 to have the non-conducting state to cause the main heater 31 to be de-energized. In step S25, the controller 33 causes the main heater 31 to be energized by changing the signal Sig4 to the level that causes the IGBT of the heater control circuit 43 to have the conducting state at a particular timing based on the time periods TD1, TD2, TD3, and TD4. The particular timing may be obtained by subtraction of a time period obtained by addition of the time period TD1 and the time period TD2 from the zero-crossing timing corresponding to the end of a half cycle. Such a control may thus enable the main heater 31 to be energized two times during a half cycle of alternating current in the heating system including the two heaters. More specifically, the main heater 31 may be energized at least during a time period from the timing at which the time period TD1 ends to the timing at which the time period TD2 ends and during a time period equal to the time period TD2 from the timing obtained by subtraction of the time period obtained by addition of the time period TD1 and the time period TD2 from the zero-crossing timing corresponding to the end of the half cycle. While reducing or preventing the alternating current passing through the main heater 31 from exceeding the rated current TH2, this control may enable the main heater 31 to be energized more efficiently than a case where the main heater 31 becomes energized during one of the above time periods. Consequently, this control may shorten FPOT while limiting power supply to the main heater 31.

In response to determining a reference zero-crossing timing in step S1, in step S3, the controller 33 changes the signal Sig4 to the level that causes the IGBT of the heater control circuit 43 to have the conducting state to cause the main heater 31 to be energized. In step S25, the controller 33 causes the main heater 31 to be energized by changing the signal Sig4 to the level that causes the IGBT of the heater control circuit 43 to have the conducting state at a particular timing, which may be obtained by subtraction of a time period obtained by addition of the time period TD1 and the time period TD2 from the zero-crossing timing corresponding to the end of a half cycle. This control may thus enable the main heater 31 to be energized for a longer duration as compared with a case where the controller 33 causes the main heater 31 to be energized at a particular timing later than the zero-crossing timing corresponding to the start of the half cycle. In addition, this control may also enable the main heater 31 to be energized for a longer duration as compared with a case where the controller 33 turns on the main heater 31 at the timing obtained by subtraction of the time period TD1 from the zero-crossing timing corresponding to the end of the half cycle.

The energization/non-energization control of the main heater 31 is controlled by the IGBT included in the heater control circuit 43. The energization/non-energization control of the auxiliary heater 32 is controlled by the IGBT included in the heater control circuit 44. In contrast to triacs, the IGBTs are capable of becoming the non-conducting state irrespective of a zero-crossing timing. The use of the IGBTs may achieve the control of the illustrative embodiment appropriately.

Figure 6:
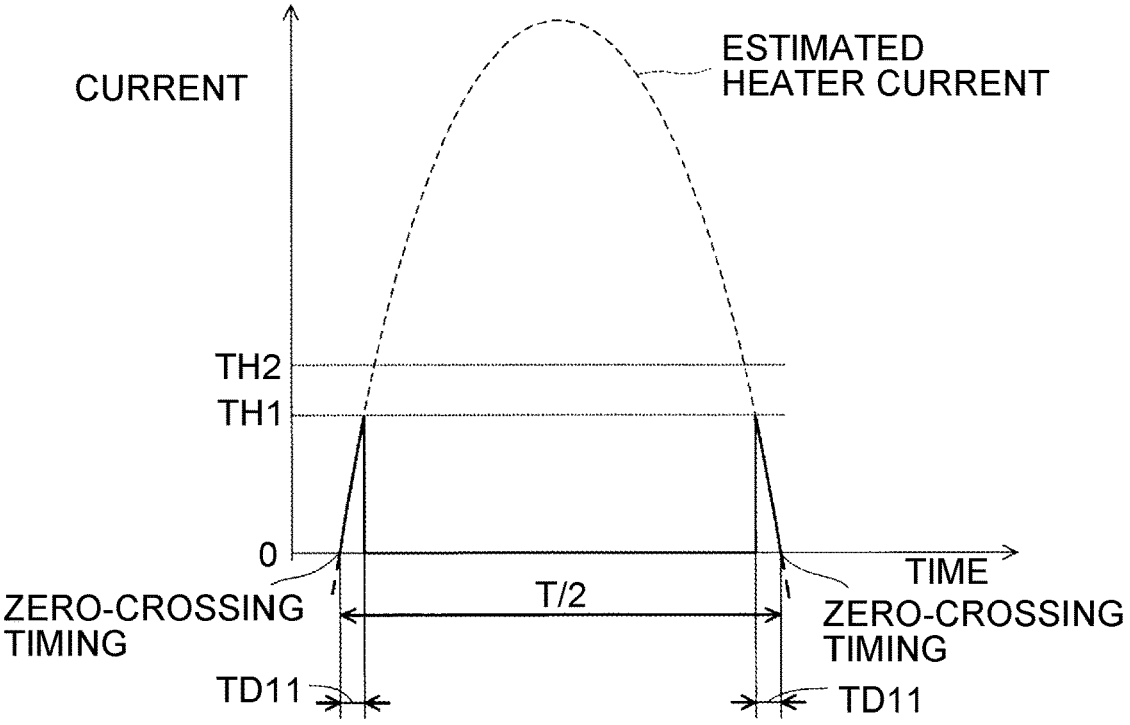
FIG. 6 is a chart showing a waveform transition during a half cycle of heater current in a heating system including a single halogen heater in another example of the illustrative embodiment according to one or more aspects of the disclosure.

In the above example of the illustrative embodiment, the heating system 30 includes two heaters. Nevertheless, in another example, the heating system 30 may include a single heater. In this case, also, the same or similar control may be applied to the heating system 30. Referring to FIG. 6, this example will be described.

The controller 33 starts heater control processing and determines a reference zero-crossing timing. In response to this, the controller 33 turns the heater on and the counter 33B to start measuring time. If the controller 33 determines that the heater current detected based on a currently input signal Sig1 has reached the threshold TH1 prestored in the memory 33A, the controller 33 turns the heater off. Further, the controller 33 causes the counter 33B to stop measuring time, and stores the measured time in the memory 33A as a time period TD11. In addition, the controller 33 causes the counter 33B to reset and newly start measuring time. In response to a time period being measured by the counter 33B elapsing a time period which is obtained by (T/2−TD11*2), the controller 33 turns the heater on.

In this example, the heater is an example of the first heater. An IGBT of a heater control circuit connected in serial to the heater is an example of the first switch. The zero-crossing timing is an example of the first timing. The threshold TH1 is an example of the threshold. The timing for turning the heater off in response to the heater current reaching the threshold TH1 is an example of the second timing and an example of the predetermined timing. The time period TD11 is an example of the time period from the start of a half cycle of alternating current to the first threshold timing at which the alternating current reaches the threshold. The timing for turning the heater on in response to the time period being measured by the counter 33B elapsing the time period which is obtained by (T/2−TD11*2) is an example of the third timing.

Figure 7:
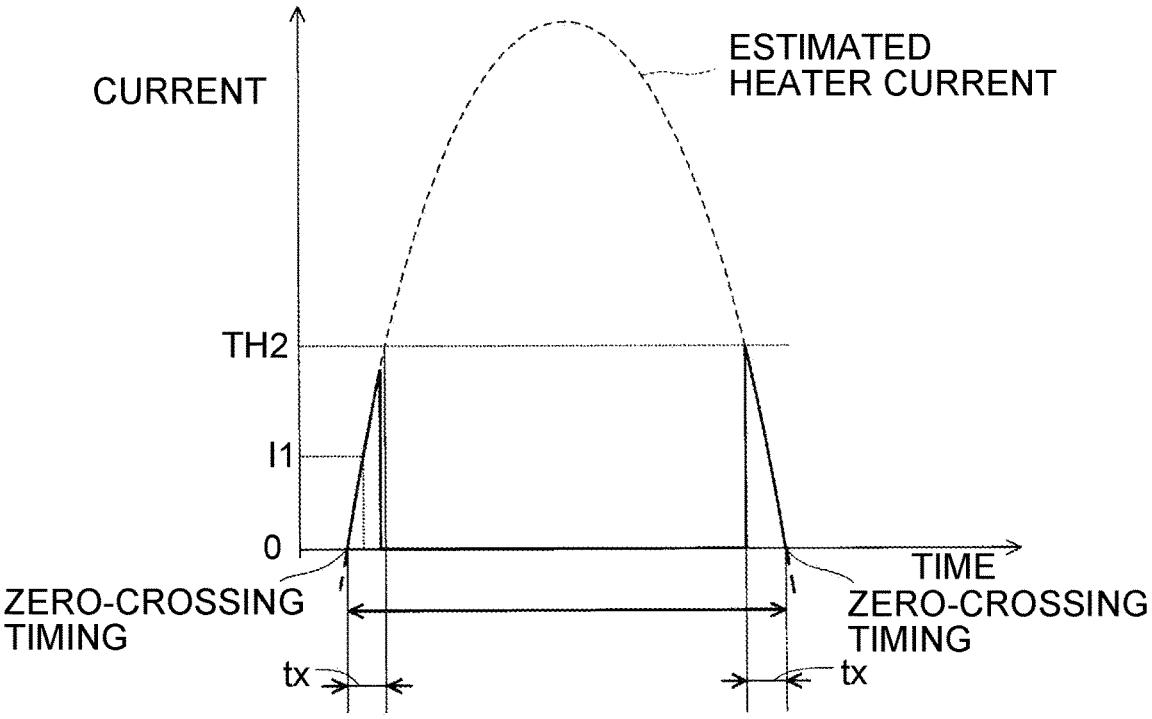
FIG. 7 is a chart for explaining how to determine ON timings for the heating system including the single halogen heater in still another example of the illustrative embodiment according to one or more aspects of the disclosure.

In the above example, in response to the heater current detected based on the signal Sig1 reaching the threshold TH1, the heater is turned off. The heater is then turned on based on the time period from the reference zero-crossing timing to the timing at which the heater is turned off. In still another example, the timing for turning the heater on may be determined based on the heater current detected based on the currently input signal Sig1. Referring to FIG. 7, this example will be described.

Current I1 indicates the heater current detected based on a signal Sig1 at a timing t1, which may be a timing at which a particular time period has elapsed from a reference zero-crossing timing. The current I1 is expressed by Equation 1 where Ip indicates a peak current of the heater current.

$$I1=Ip*\sin(2\pi*(T/2-t1)/T); \quad \text{Equation 1}$$

Equation 1 is transformed into Equation 2.

$$Ip=I1/(\sin(2\pi(T/2-t1)/T)); \quad \text{Equation 2}$$

For obtaining a timing at which the heater current reaches the rated current TH2, Equation 3 may be used, where tx indicates a time period required for the heater current to reach the rated current TH2 from a reference zero-crossing timing.

$$TH2=Ip*\sin(2\pi*(T/2-tx)/T); \quad \text{Equation 3}$$

Equation 3 is arranged to Equation 4 below.

$$tx=T/2-\text{arc}\sin(TH2/Ip)*T/(2\pi); \quad \text{Equation 4}$$

Thus, the controller 33 turns the heater off at a timing at which the time period tx obtained by Equation 4 elapses from the reference zero-crossing timing. In another example, the controller 33 may turn the heater off before the time period tx elapses from the reference zero-crossing timing.

The controller 33 then turns the heater on at a timing at which the time being measured reaches a time of (T/2−tx) from the reference zero-crossing timing.

In this example, Equation 1 is an example of an expression representing variation of alternating current passing through the first heater from the first timing to the first threshold timing. The timing t1 is an example of the predetermined timing. The current I1 is an example of a value detected based on a signal received from a current sensor at the predetermined timing. The timing for turning the heater off at the timing at which the time period tx elapses from the reference zero-crossing timing is an example of the second timing. The timing for turning the heater on at the timing at which the time being measured reaches the time of (T/2−tx) from the reference zero-crossing timing is an example of the third timing.

This example may thus achieve effects as follows.

The controller 33 determines Equation 1 using the timing t1 and the current I1 detected at the timing t1. The controller 33 further obtains the time period tx required for the heater current to reach the rated current TH2 using Equation 1 and the rated current TH2. Thus, the controller 33 may accurately estimate and determine the timing at which the heater current reaches the rated current TH2, using the timing t1 and the current I1 detected at the timing t1.

While the disclosure has been described in detail with reference to the specific embodiment thereof, these are merely examples, and various changes, arrangements and modifications may be applied therein without departing from the spirit and scope of the disclosure.

In the illustrative embodiment, in response to determining a reference zero-crossing timing in step S1, the controller 33 turns both of the main heater 31 and the auxiliary heater 32 on in step S3. Nevertheless, in other embodiments, for example, the controller 33 may turn at least one of the main heater 31 and the auxiliary heater 32 on at a particular timing after the reference zero-crossing timing occurs. In still other embodiments, the controller 33 may turn the main heater 31 and the auxiliary heater 32 at respective different timings.

In the illustrative embodiment, if the controller 33 makes a negative determination (e.g., "NO") in step S31, the routine returns to step S1. That is, the controller 33 repeats the processing of steps S1 to S31 every half cycle. In such a case, the controller 33 might not determine each of the ON timings every half cycle. Once the controller 33 determines ON timings in a particular half cycle, the controller 33 may use the same ON timings in two or more successive half cycles subsequent to the particular half cycle. Thus, the main heater 31 and the auxiliary heater 32 are turned on at the respective same ON timings in the half cycles subsequent to the particular half cycle as the ON timings used in the particular half cycle.

In the examples of the first illustrative embodiment, the heater control circuits 43 and 44 each include an IGBT. Nevertheless, in other embodiments, for example, the heater control circuits 43 and 44 may each include another semiconductor device such as a field-effect transistor ("FET").

Examples of the current sensor includes the current sensor 37 that is disposed on the line connecting between the AC supply 101 and the AC/DC convertor 34. Nevertheless, in other embodiments, for example, a current sensor may be disposed on a route that may be branched off from the line connecting between the AC supply 101 and the AC/DC convertor 34 and may extend to the relay 42. In still other embodiments, for example, two current sensors may be provided. More specifically, the current sensors may include a current sensor that may be disposed on a route that may be branched off from a line connecting the relay 42 to the main heater 31 and the auxiliary heater 32 and may extend to the main heater 31, and another current sensor that may be disposed on a route that may be branched off from a line connecting the relay 42 to the main heater 31 and the auxiliary heater 32 and may extend to the auxiliary heater 32.

In the illustrative embodiment, the main heater 31 consumes more power than the auxiliary heater 32. Nevertheless, in other embodiments, for example, the auxiliary heater 32 may consume more power than the main heater 31. The one or more aspects of the disclosure may be applied to any image processing device including two heaters.

Example of the image forming apparatus includes other printers such as a color laser printer and a printer for forming an electrostatic latent image on a circumferential surface of a photosensitive drum by irradiation using an LED, and multifunction devices having multiple functions such as a copying function, as well as the monochrome laser printer 1.

What is claimed is:

1. A heating system comprising:

a first heater;

a current sensor connected in series to the first heater;

a first switch connected in series to the first heater, the first switch configured to:

in response to receiving a first ON signal, change to a conducting state; and in response to receiving a first OFF signal, change to a non-conducting state; and a controller configured to:

output the first ON signal to the first switch at a first timing within a portion of a half cycle of alternating current having increasing amplitude;

output the first OFF signal to the first switch at a second timing earlier than a first threshold timing, the first threshold timing being a timing at which a signal received from the current sensor reaches a threshold within the portion of the half cycle having increasing amplitude;

determine, based on a signal received from the current sensor at a predetermined timing between the first timing and the second timing, a time period from the start of the half cycle of the alternating current to the first threshold timing;

obtain a third timing by subtraction of the determined time period from an end of the half cycle of the alternating current; and output the first ON signal to the first switch at a timing on or after the obtained third timing during the half cycle.

2. The heating system according to claim 1, wherein the second timing occurs when a value of the signal received from the current sensor that corresponds to the alternating current changes from being less than a predetermined value smaller than the threshold to being within a range from the predetermined value to the threshold.

3. The heating system according to claim 2, wherein the predetermined timing comprises a timing at which a value of the signal received from the current sensor that corresponds to the alternating current is within the range from the predetermined value to the threshold.

4. The heating system according to claim 1, wherein the controller is configured to calculate the time period from the start of the half cycle of the alternating current to the first threshold timing based on at least the predetermined timing, a value of the signal received from the current sensor at the predetermined timing, and the threshold of the alternating current.

5. The heating system according to claim 1, wherein the controller is further configured to output the first ON signal to the first switch at the third timing.

6. The heating system according to claim 1, wherein the first timing comprises the start of the half cycle of the alternating current.

7. The heating system according to claim 1, further comprising:

a second heater connected in parallel to the first heater and the first switch and in series to the current sensor; and a second switch connected in series to the second heater and in parallel to the first heater, the second switch configured to:

in response to receiving a second ON signal, change to a conducting state; and in response to receiving a second OF signal, change to a non-conducting state, wherein the controller is further configured to:

output the second ON signal to the second switch at a fourth timing earlier than the second timing within the half cycle, the fourth timing occurring prior to the predetermined timing at which the signal is received to determine the time period;

output the second OFF signal to the second switch at a fifth timing occurring after the second timing and before a second threshold timing at which a signal received from the current sensor is determined to reach the threshold;

determine a second time period from the start of the half cycle of the alternating current to the second threshold timing, based on a signal received from the current sensor at a second predetermined timing between the second timing and the fifth timing;

obtain a sixth timing by subtraction of the determined second time period from the end of the half cycle of the alternating current; and output the second ON signal to the second switch at a timing on or after the obtained sixth timing.

8. The heating system according to claim 7, wherein the controller is configured to output the second ON signal to the second switch at the sixth timing.

9. The heating system according to claim 7, wherein the fourth timing comprises the start of the half cycle of the alternating current.

10. The heating system according to claim 7, wherein each of the first switch and the second switch includes an IGBT.

11. The heating system according to claim 7, wherein the first heater and the second heater are installed within an image forming apparatus.

12. A heating system, comprising:

a heater;

a switch electrically connected between an alternating current power supply and the heater, the switch configured to:

in response to receiving an ON signal, change to a conducting state to provide alternating current from the alternating current power supply to the heater; and in response to receiving an OFF signal, change to a non-conducting state to interrupt the alternating current;

a current sensor electrically connected between the switch and the heater; and a controller configured to:

output the ON signal to the switch at a first timing within a portion of a half cycle of alternating current having increasing amplitude;

output the OFF signal to the switch at a second timing earlier than a threshold timing at which the alternating current reaches a threshold within the portion of the half cycle having increasing amplitude;

determine, based on a signal received from the current sensor at a predetermined timing between the first timing and the second timing, a time period from the start of the half cycle of the alternating current to the threshold timing;

obtain a third timing by subtraction of the determined time period from an end of the half cycle of the alternating current; and output the ON signal to the switch at a timing on or after the obtained third timing during the half cycle.

* * * * *